US009016285B2

(12) United States Patent
Riddick

(10) Patent No.: US 9,016,285 B2
(45) Date of Patent: Apr. 28, 2015

(54) FLUE-CURING APPARATUS AND ASSOCIATED METHOD

(75) Inventor: Marvin Glenn Riddick, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 195 days.

(21) Appl. No.: 13/475,172

(22) Filed: May 18, 2012

(65) Prior Publication Data

US 2013/0306083 A1 Nov. 21, 2013

(51) Int. Cl.
*A24B 3/12* (2006.01)
*A24B 3/04* (2006.01)

(52) U.S. Cl.
CPC .... *A24B 3/12* (2013.01); *A24B 3/04* (2013.01)

(58) Field of Classification Search
CPC ..... A24B 1/02; A24B 3/04; A24B 3/12
USPC ..... 99/467–482; 219/400–401
See application file for complete search history.

(56) References Cited

U.S. PATENT DOCUMENTS

| | | | | | |
|---|---|---|---|---|---|
| 1,547,958 | A | | 7/1925 | Ring | |
| 2,082,289 | A | | 6/1937 | Hodgin | |
| 2,134,843 | A | | 11/1938 | Rouse | |
| 2,475,568 | A | | 7/1949 | Moore, Jr. | |
| 2,798,496 | A | * | 7/1957 | Jones | 131/303 |
| 3,110,326 | A | | 11/1963 | Hassler | |
| 3,134,583 | A | | 5/1964 | Wilson | |
| 3,244,445 | A | | 4/1966 | Wilson | |
| 3,251,620 | A | | 5/1966 | Hassler | |
| 3,503,137 | A | | 3/1970 | Wilson | |
| 3,664,034 | A | | 5/1972 | Wilson | |
| 3,669,429 | A | | 6/1972 | Dew | |
| 3,937,227 | A | | 2/1976 | Azumano | |
| 3,948,277 | A | * | 4/1976 | Wochnowski et al. | 131/303 |
| 4,011,041 | A | | 3/1977 | Taylor | |
| 4,021,928 | A | | 5/1977 | Johnson | |
| 4,114,288 | A | | 9/1978 | Fowler | |
| 4,192,323 | A | | 3/1980 | Horne | |
| 4,206,554 | A | | 6/1980 | Fowler | |
| 4,263,721 | A | * | 4/1981 | Danford | 34/514 |
| 4,424,024 | A | | 1/1984 | Wilson et al. | |
| 4,499,911 | A | * | 2/1985 | Johnson | 131/302 |
| 4,559,956 | A | * | 12/1985 | De Lange et al. | 131/303 |
| 5,558,793 | A | * | 9/1996 | McKee et al. | 219/391 |
| 6,202,649 | B1 | | 3/2001 | Williams | |
| 7,293,564 | B2 | | 11/2007 | Perfetti et al. | |
| 2002/0179588 | A1 | * | 12/2002 | Lubrina et al. | 219/400 |

(Continued)

*Primary Examiner* — Richard Crispino
*Assistant Examiner* — Eric Yaary
(74) *Attorney, Agent, or Firm* — Womble Carlyle Sandridge & Rice, LLP

(57) ABSTRACT

A flue-curing apparatus and a related method are provided. The flue-curing apparatus includes a circulation chamber and a curing chamber that are separated by a divider wall. An air circulation system includes a blower positioned in the circulation chamber that directs air to a heater device and a lower passage into the curing chamber. The air may be received from one or both of an inlet and an upper passage extending from the curing chamber to the circulation chamber. A humidity control system humidifies the air directed into the curing chamber. A controller may receive signals from wet and dry bulb thermometers to determine the conditions in the curing chamber and the condition of tobacco leaves being cured therein. The controller may adjust various operational parameters to cause the tobacco leaves in the curing chamber to cure at a desired rate.

14 Claims, 10 Drawing Sheets

(56) References Cited

U.S. PATENT DOCUMENTS

2004/0155024 A1* 8/2004 Audette et al. ..... 219/400
2005/0173397 A1* 8/2005 Majchrzak et al. ..... 219/401
2006/0081592 A1* 4/2006 Williams et al. ..... 219/401
2006/0156927 A1* 7/2006 Udagawa et al. ..... 96/417
2010/0003387 A1* 1/2010 Knight ..... 426/523
2010/0229896 A1* 9/2010 Bartelick ..... 134/22.1
2014/0083309 A1* 3/2014 Reese et al. ..... 99/474

* cited by examiner

FLUE-CURING APPARATUS AND ASSOCIATED METHOD

BACKGROUND OF THE DISCLOSURE

1. Field of the Disclosure

The present disclosure relates to products made or derived from tobacco, or that otherwise incorporate tobacco, and are intended for human consumption. In this regard, aspects of the present disclosure relate to flue-curing of tobacco, and, more particularly, to apparatuses and associated methods for flue-curing research quantities of tobacco leaves.

2. Description of Related Art

In the production of tobacco products, the tobacco may be cured. Curing refers to preparation of the tobacco for consumption. Curing degrades and oxidizes carotenoids in tobacco leaves, producing a consumable item with desirable taste attributes. In this regard, starch in the tobacco leaves may be converted to sugar as the leaves are cured.

Methods for curing tobacco include air-curing, fire-curing, flue-curing, and sun-curing. By way of example, flue-curing may be used to produce tobacco for cigarettes. Flue curing may involve hanging leaves in a barn or box defining a chamber in which a heat supply such as a radiator provides heat to the air in the chamber.

However, the conditions under which tobacco leaves are cured may affect the quality of the resulting tobacco product. Accordingly, improvements with respect to curing apparatuses and methods may be desirable.

BRIEF SUMMARY OF THE DISCLOSURE

In one aspect, a flue-curing apparatus for tobacco is provided. The flue-curing apparatus may comprise an air circulation system, a humidity control system operably engaged with the air circulation system so as to control humidity in air being circulated thereby, a heater device operably engaged with the air circulation system so as to heat air being circulated thereby, and a chamber operably engaged with the air circulation system. The chamber may be configured to receive a plurality of tobacco leaves therein, and in one embodiment the chamber may be further configured to have a capacity of no more than about twenty five pounds of tobacco leaves. The chamber may be configured to receive the heated and humidity-controlled air from the air circulation system at a lower portion thereof and to direct the air substantially uniformly through the tobacco leaves, such that the tobacco leaves experience substantially the same heat and humidity associated with the air, and back to the air circulation system from an upper portion of the chamber.

In some embodiments the chamber may comprise a perforated member at the lower portion. The chamber may be configured to receive the heated and humidity-controlled air from the air circulation system through the perforated member. Further, the chamber may comprise a plurality of hanging racks disposed between the lower portion and the upper portion of the chamber and configured to receive the tobacco leaves such that the tobacco leaves hang therefrom. The hanging racks may be arranged at least one of serially and in parallel between the lower portion and the upper portion of the chamber.

In some embodiments the chamber may comprise an access door. The access door may be configured to open and close the chamber, the access door and at least one of the hanging racks may be configured to form a seal therebetween when the access door is closed so as to direct the heated and humidity-controlled air from the air circulation system through the tobacco leaves hanging from the hanging racks.

The apparatus may further comprise a gasket member operably engaged with at least one of the access door and the one of the hanging racks and configured to facilitate the seal therebetween. The access door of the chamber may comprise a transparent viewing window configured to allow visual inspection of the tobacco leaves within the chamber.

In some embodiments the humidity control system may comprise a plurality of spray nozzles configured to have water directed therethrough. The apparatus may further comprise a drip tray positioned under the spray nozzles so as to collect water dispensed therefrom and not incorporated into the heated and humidity-controlled air. The spray nozzles may be configured to receive heated water for direction therethrough. The spray nozzles may be disposed externally to the chamber. The humidity control system may further comprise a solenoid valve configured to control the flow of water to the spray nozzles.

In some embodiments the apparatus may further comprise a controller configured to control at least one condition of the air at least partially in response to a signal from a sensor in the chamber. The sensor may comprise a wet bulb thermometer. Further, the air circulation system may comprise a fresh air damper configured to selectively introduce external air into the air circulated through the chamber. Additionally, the air circulation system may comprise a variable speed blower. In some embodiments the apparatus may be configured as a mobile unit.

In another aspect, a method for flue-curing tobacco is provided. The method may comprise directing a heated and humidity-controlled air from an air circulation system into a lower portion of a chamber configured to receive a plurality of tobacco leaves therein, the chamber may be further configured to have a capacity of no more than about twenty five pounds of tobacco leaves. The method may also include directing the air substantially uniformly through the tobacco leaves, such that the tobacco leaves experience substantially the same heat and humidity associated with the air. Further, the method may include directing the air back to the air circulation system from an upper portion of the chamber.

In some embodiments, directing the air from the air circulation system into the lower portion of a chamber may further comprise directing the air from the air circulation system into the lower portion of the chamber through a perforated member disposed at the lower portion of the chamber. The method may additionally include hanging the tobacco leaves on a plurality of hanging racks disposed between the lower portion and the upper portion of the chamber and configured to receive the tobacco leaves. Also, the method may include forming a seal between an access door, which may be configured to open and close the chamber, and at least one of the hanging racks, when the access door is closed, such that the heated and humidity-controlled air from the air circulation system is directed through the tobacco leaves hanging from the hanging racks. Forming the seal may comprise forming the seal with a gasket member operably engaged with at least one of the access door and the one of the hanging racks and configured to facilitate the seal therebetween.

In some embodiments the method may also include visually inspecting the tobacco leaves within the chamber through a transparent viewing window associated with the access door. Further, the method may include directing water through a plurality of spray nozzles disposed externally to the chamber to control the humidity of the air. Also, the method may include controlling at least one condition of the air at least partially in response to a signal from a sensor comprising a wet bulb thermometer disposed in the chamber. The method may additionally include selectively introducing external air through a fresh air damper into the air circulated through the chamber.

Aspects of the present disclosure thus address the identified needs and provide other advantages as otherwise detailed herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DISCLOSURE

Figure 1:
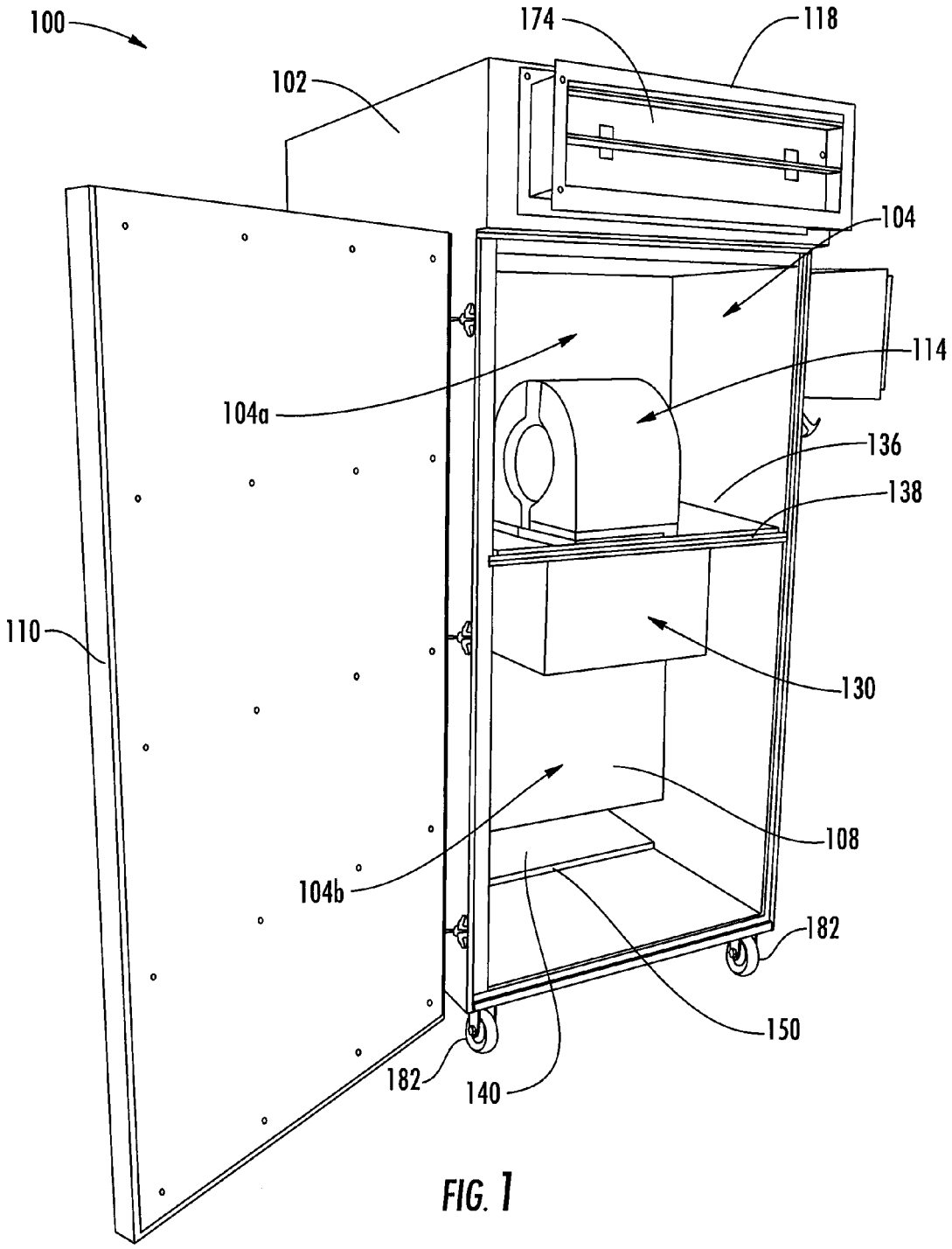
FIG. 1 illustrates a perspective view of a flue-curing apparatus and a circulation chamber thereof according to an example embodiment of the present disclosure.

The present disclosure now will be described more fully hereinafter with reference to the accompanying drawings, in which some, but not all aspects of the disclosure are shown. Indeed, the disclosure can be embodied in many different forms and should not be construed as limited to the aspects set forth herein; rather, these aspects are provided so that this disclosure will satisfy applicable legal requirements. Like numbers refer to like elements throughout.

In the production of tobacco products, tobacco leaves may be cured in order to convert the tobacco to a consumable form. Example embodiments of curing methods are discussed in U.S. Pat. No. 7,293,564 to Perfetti et al., which is incorporated herein by reference in its entirety. Briefly, however, subjecting tobacco to curing conditions typically involves the application of heat. Flue-curing may be conducted in barns or boxes. Each curing barn (or box) is equipped with a heating source, such as a direct-fire heating unit, but is most preferably equipped with an indirect heating source, such as an electrical heating unit or heat exchanger. The curing barn also typically is equipped with a fan for circulating air within the barn and manual or automated temperature and humidity controls. Exemplary curing barns and methods for curing tobacco are described in U.S. Pat. No. 1,547,958 to Ring; U.S. Pat. No. 2,082,289 to Hodgin; U.S. Pat. No. 2,134,843 to Rouse; U.S. Pat. No. 2,474,534 to Horne; U.S. Pat. No. 2,475,568 to Moore, Jr.; U.S. Pat. No. 3,110,326 to Hassler; U.S. Pat. No. 3,134,583 to Wilson; U.S. Pat. No. 3,244,445 to Wilson; U.S. Pat. No. 3,251,620 to Hassler; U.S. Pat. No. 3,503,137 to Wilson; U.S. Pat. No. 3,664,034 to Wilson; U.S. Pat. No. 3,669,429 to Dew; U.S. Pat. No. 3,937,227 to Azumano; U.S. Pat. No. 4,011,041 to Taylor; U.S. Pat. No. 4,021,928 to Johnson; U.S. Pat. No. 4,114,288 to Fowler; U.S. Pat. No. 4,192,323 to Horne; U.S. Pat. No. 4,206,554 to Fowler; U.S. Pat. No. 4,247,992 to MacGregor; U.S. Pat. No. 4,267,645 to Hill; U.S. Pat. No. 4,424,024 to Wilson et al. U.S. Pat. No. 4,499,911 to Johnson; U.S. Pat. No. 5,685,710 to Martinez Sagrera et al.; U.S. Pat. No. 6,202,649 to Williams; and U.S. Pat. No. 6,425,401 to Williams; and Canadian Patent No. 1,026,186. In North America, and particularly in the U.S.A., tobacco curing barns are manufactured and supplied by various companies, including Long Manufacturing Inc., Taylor Manufacturing Company, Powell Manufacturing Company, Tharrington Industries, and DeCloet Ltd. Other curing barns are available throughout the world, and exemplary barns can be provided by VenconVarsos of Athens, Greece. Tobacco curing barns have been manufactured and operated in traditional manners for many years, and the design, manufacture and use of such barns will be readily apparent to those skilled in the art of tobacco curing.

Curing barns and boxes are typically configured to cure large quantities of tobacco leaves (e.g., about 2500 pounds). As the leaves are heated (e.g., via a radiator), the moisture exiting the leaves may maintain a proper level of humidity in the structure such that the leaves are cured at an appropriate rate and conversion of starch in the tobacco leaves to sugar occurs.

However, during research relating to tobacco crops, it may be desirable to cure considerably smaller quantities of tobacco leaves (e.g., up to about 20 pounds). For example, a small number of various types of tobacco plants may be planted, the leaves thereof may be cured, and then the characteristics of the resulting cured tobacco may be analyzed. Accordingly, tobacco plants determined to have desirable attributes may then be planted for production purposes in greater numbers.

In order to properly cure the tobacco leaves, researchers have relied on techniques such as placing the tobacco leaves in standard curing barns or boxes which are filled with typical large quantities of tobacco leaves. Thus, researchers may share space in curing barns or boxes with tobacco being grown for production purposes. However, sharing space in curing barns or boxes may require researchers to wait for a farmer to fill and use the curing barn or box. Further, sharing a curing barn or box presents risks with respect to contamination from, or confusion with, the other tobacco leaves. Additionally, a researcher may not be able to precisely control the conditions under which the tobacco leaves are cured when sharing space in a curing barn or box. Accordingly, it may be desirable to provide an apparatus configured to cure relatively smaller quantities of tobacco leaves.

In this regard, embodiments of the disclosure relate to a flue-curing apparatus configured to cure tobacco leaves or other crops. For purposes of brevity, crops cured by the flue-curing apparatus are generally referred to herein as tobacco leaves. However, various other types of crops may be cured in the flue-curing apparatus. In some embodiments the flue-curing apparatus disclosed herein may be configured to cure a research quantity of crops. A research quantity of crops, as used herein, refers to a quantity of crops up to about 5 pounds, up to about 20 pounds, up to about 25 pounds, or up to about 50 pounds. However, the flue-curing apparatus may be scaled to cure various other quantities of crops in other embodiments.

Figure 2:
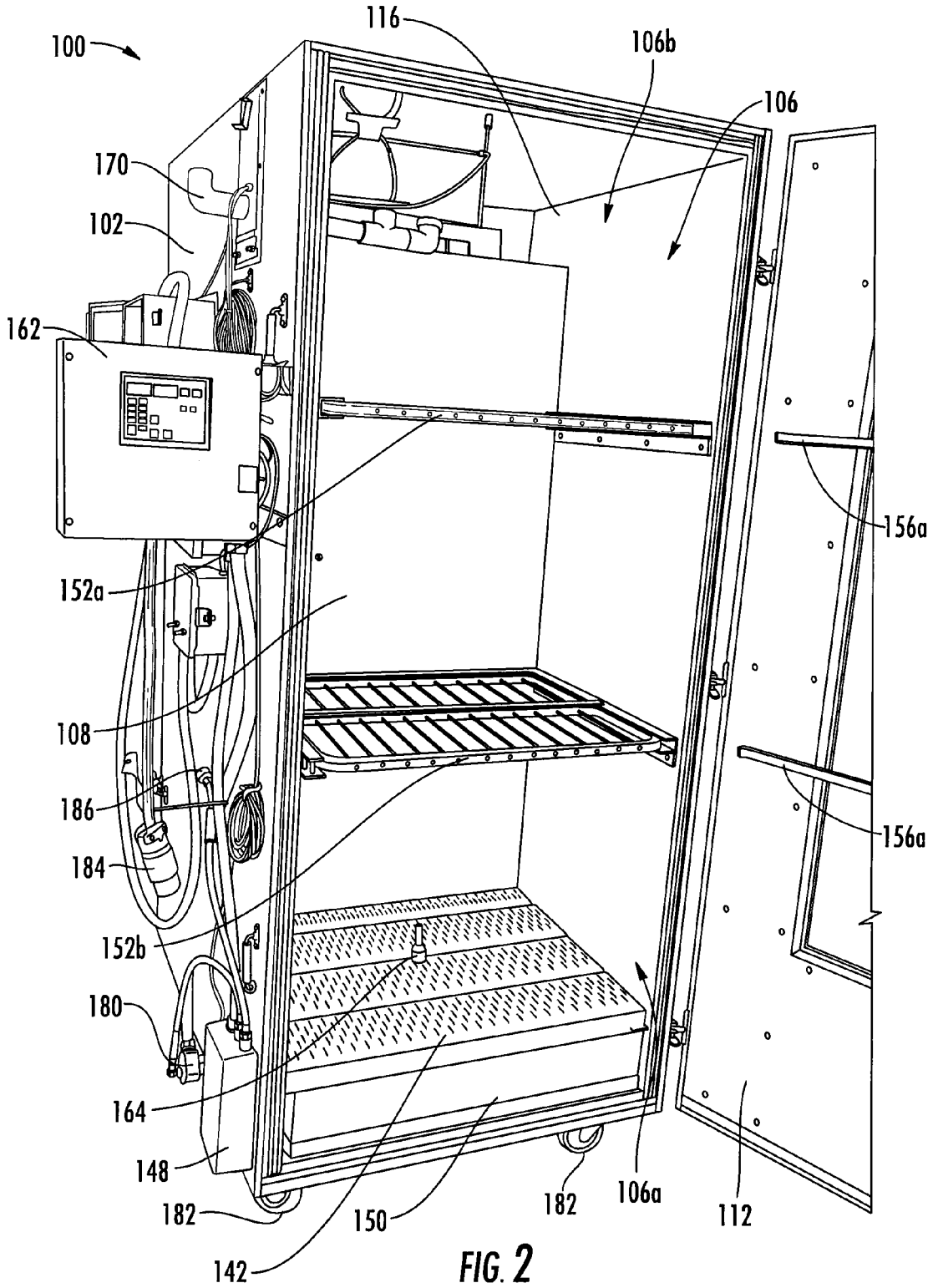
FIG. 2 illustrates an alternate perspective view of the flue-curing apparatus of FIG. 1 and a curing chamber thereof.

FIGS. 1 and 2 illustrate perspective views of an example embodiment of a flue-curing apparatus 100. The flue-curing apparatus 100 comprises a housing 102 that defines a circulation chamber 104 (see, e.g., FIG. 1), a curing chamber 106 (see, e.g., FIG. 2) configured to receive a plurality of tobacco leaves, and a divider wall 108 between the curing chamber and the circulation chamber. An access door 110 to the circulation chamber 104 and an access door 112 to the curing chamber 106 are illustrated in open configurations in FIGS. 1 and 2. When the access doors 110, 112 are in the open configurations, a user may be provided with access to the circulation chamber 104 and the curing chamber 106. For example, a user may clean or service components inside the circulation chamber 104 or insert or remove tobacco leaves from the curing chamber 106. However, during use of the flue-curing apparatus 100, the access doors 110, 112 to the circulation chamber 104 and the curing chamber 106 may remain closed in order to cause air traveling through the research curing cabinet to follow a desired flow path. In particular, as described below, the curing chamber 106 may be configured to receive heated and humidity-controlled air from the circulation chamber 104 and direct the air substantially uniformly through tobacco leaves in the curing chamber, such that the tobacco leaves experience substantially the same heat and humidity associated with the air, and back to the circulation chamber.

In this regard, flue-curing apparatus 100 may include an air circulation system. The air circulation system may include a blower 114 positioned in the circulation chamber 104. The blower 114 may be configured to receive air from at least one of the curing chamber 106, through an upper passage 116 extending from the curing chamber 106 to the circulation chamber 104, and an inlet 118 to the circulation chamber 104. Thus, the air circulation system may be configured such that the blower 114 may receive air from the curing chamber 106 or fully or partially receive air through the inlet 118 from an external environment.

Figure 3:
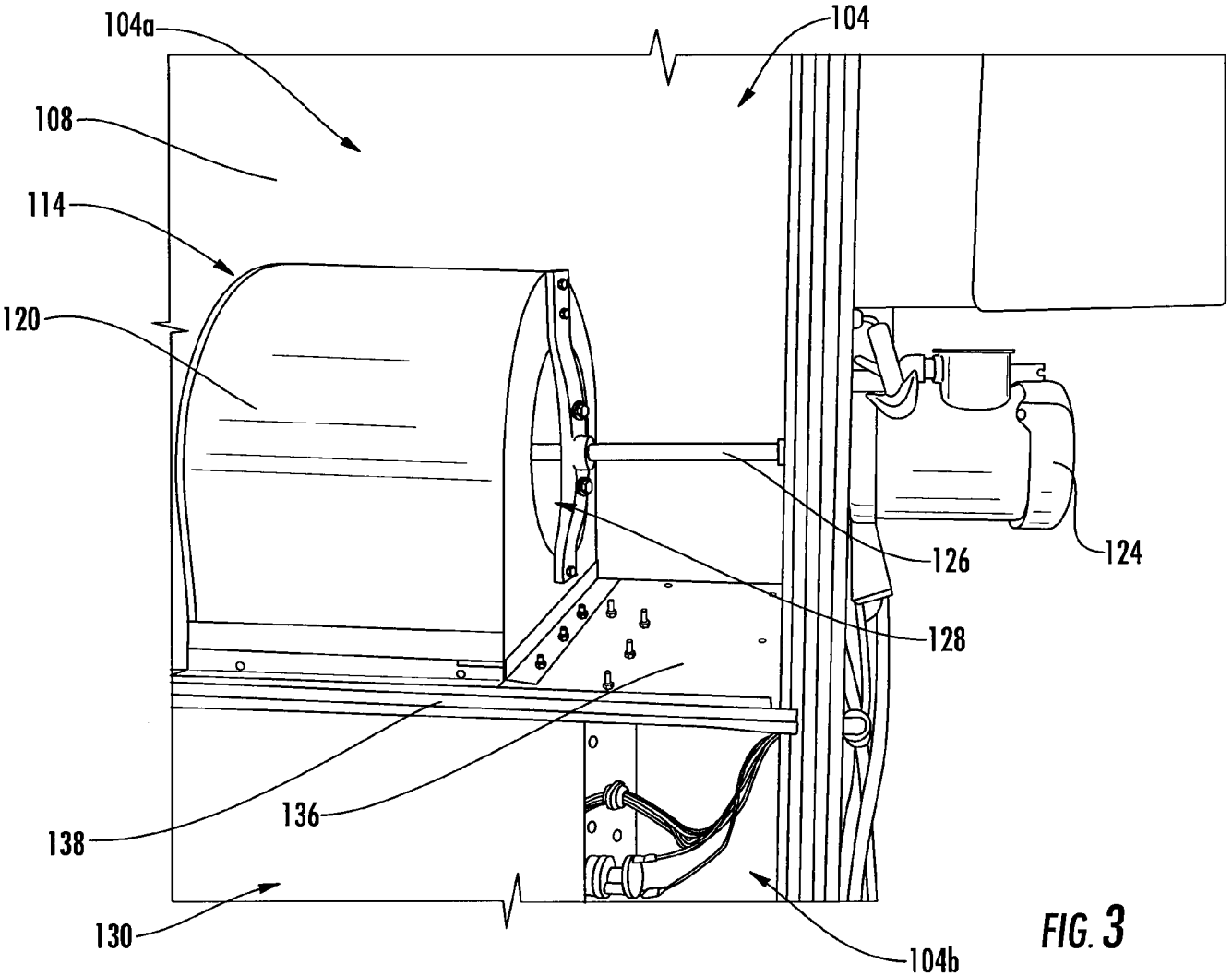
FIG. 3 illustrates an enlarged perspective view of a blower in the curing chamber.

As illustrated in FIG. 3, the blower 114 may comprise a blower housing 120 in which a plurality of blades 122 (see, e.g., FIG. 4) are positioned. A motor 124 (e.g., an electric motor) may drive a shaft 126 in order to rotate the blades 122. Accordingly, the blower 114 may draw air through the upper passage 116 and/or the inlet 118 into the circulation chamber 104. In the circulation chamber 104, the air is then drawn into an inlet opening 128 to the blower 114 and forced outwardly thereof by the blades 122.

Figure 4:
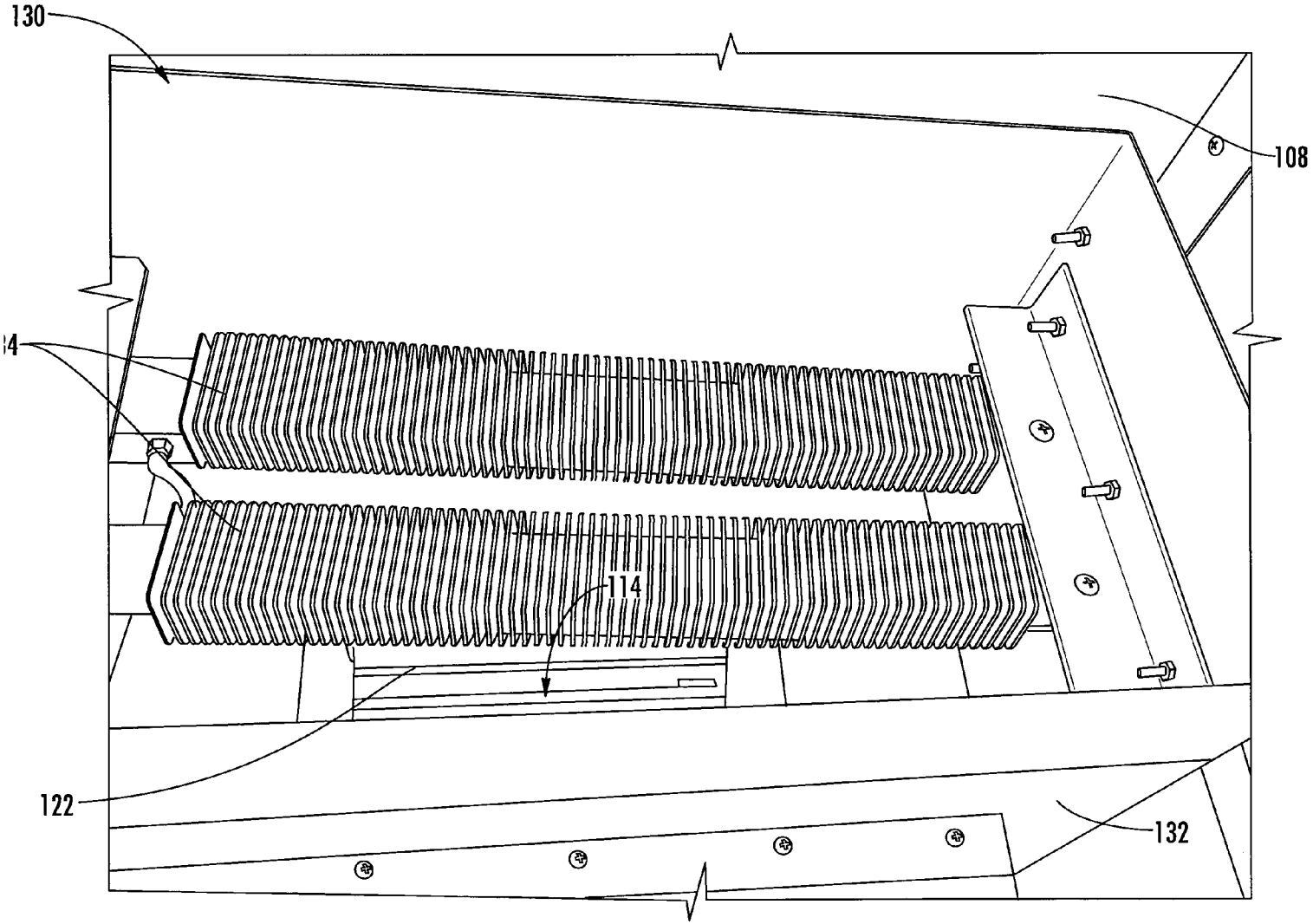
FIG. 4 illustrates a bottom view of a heater device configured to receive air from the blower.

In one embodiment the air may be heated by a heater device 130 operably engaged with the air circulation system after the air is discharged from the blower 114 so as to heat the air being circulated thereby. As illustrated in FIG. 4, which is a view upwardly from underneath the blower 114, the heater device 130 may comprise a heater housing 132 that directs the air received from the blower over one or more heating elements 134. In one embodiment the heater device 130 may comprise an electric heater and the heating elements 134 may comprise electric heating elements. Use of indirect heaters such as electric heating elements may avoid issues with respect to production of nitrosamines. However, various other types of heater devices may be employed in other embodiments.

The circulation chamber 104 may include a separator wall 136 with a seal 138 that is configured to engage the access door 110 to the circulation chamber. In this regard, air received from an upper portion 104*a* of the circulation chamber 104 may be forced into and out of a lower portion 104*b* of the circulation chamber by the blower 114. In particular, after the air is heated by the heater device 130, the air may be directed through a lower passage 140 extending from the circulation chamber 104 to the curing chamber 106 under the divider wall 108 and into a lower portion 106*a* of the curing chamber 106.

Figure 5:
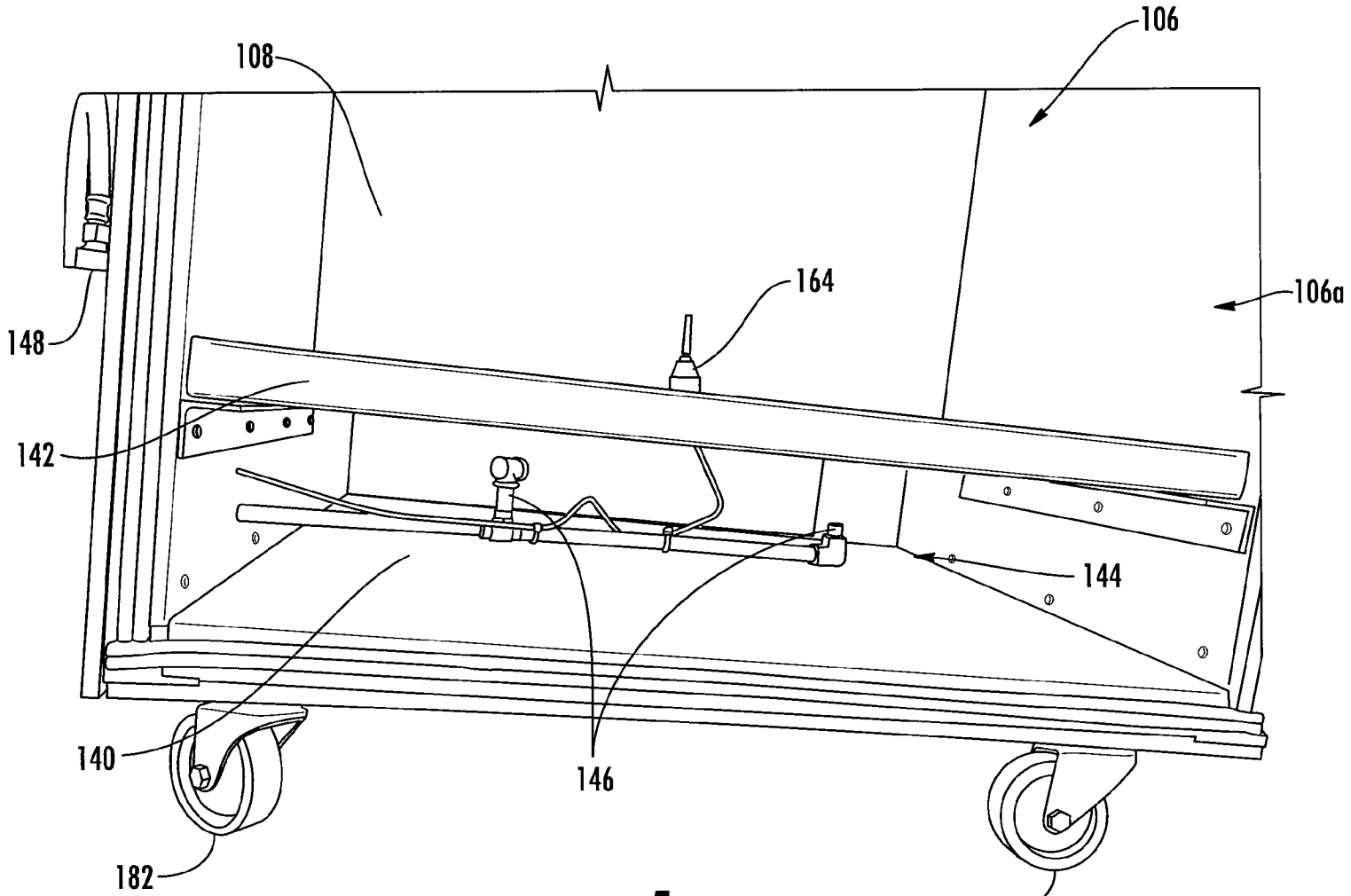
FIG. 5 illustrates an enlarged view through a lower passage extending from the circulation chamber to the curing chamber.

In some embodiments the curing chamber 106 may comprise a perforated member 142 at the lower portion 106*a*. The curing chamber 106 may be configured to receive the heated and humidity-controlled air from the air circulation system and the humidity control system through the perforated member 142. In particular, the air may be directed up through a perforated member 142 as the air enters the lower portion 106*a* of the curing chamber 106, as illustrated in FIG. 5. The perforated member 142 may act as a restriction that causes the air to flow substantially uniformly therethrough such that each of the tobacco leaves in the curing chamber 106 experience substantially the same air flow conditions.

The flue-curing apparatus 100 may further comprise a humidity control system operably engaged with the air circulation system so as to control humidity in air being circulated thereby. The humidity control system may include a humidifier arrangement 144, which may be positioned such that the perforated member 142 is between the curing chamber 106 and the humidifier arrangement. The perforated member 142 may protect the humidifier arrangement from pieces of tobacco leaves landing thereon while allowing air to travel upwardly therethrough.

In some embodiments the humidifier arrangement 144 may comprise spray nozzles 146, which may be positioned externally to the curing chamber 106, that are configured to have water directed therethrough. In some embodiments the spray nozzles 146 may be configured to receive a heated supply of water for direction therethrough from a hot water heater 148 (e.g., a tankless water heater). Thus, due to the positioning of the humidifier arrangement 144 under the curing chamber 106, the spray nozzles 146 may spray heated water into the heated air in order to increase the humidity of the air entering the curing chamber. A drip tray 150 (see, e.g., FIGS. 1 and 2) may be positioned under the spray nozzles 146 so as to collect water dispensed therefrom and not incorporated into the heated and humidity controlled air directed into the curing chamber 106.

Figure 6:
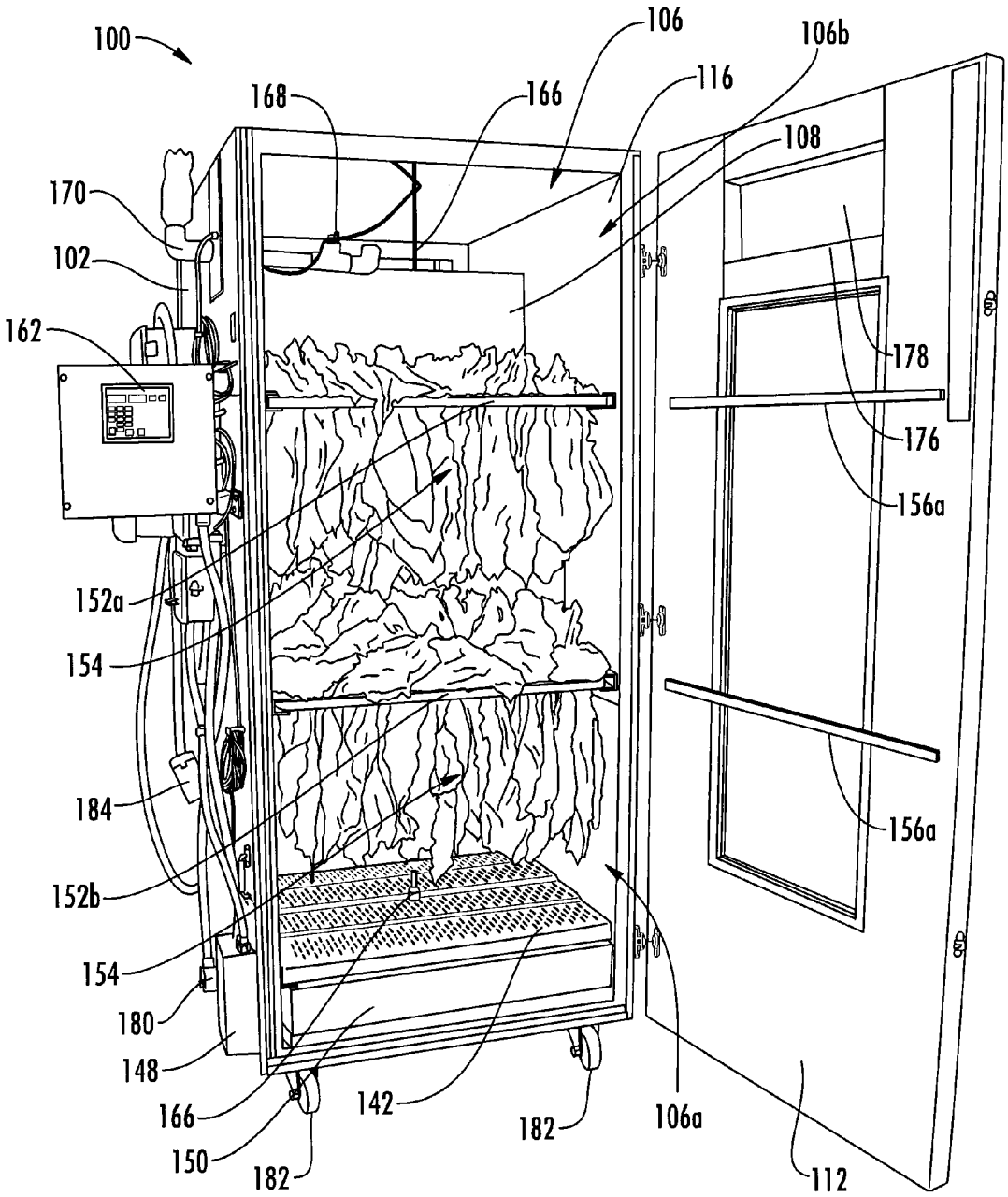
FIG. 6 illustrates a perspective view of the flue-curing apparatus with a plurality of tobacco leaves received in the curing chamber.

The curing chamber 106 may be operably engaged with the air circulation system and configured to receive a plurality of tobacco leaves therein. As noted above, the curing chamber 106 may be configured to have a capacity in some embodiments of no more than about 5 pounds, no more than about 20 pounds, no more than about 25 pounds, or no more than about 50 pounds of tobacco leaves. As illustrated in FIG. 2, the curing chamber 106 may comprise a plurality of hanging racks 152 positioned between the lower portion 106*a* and the upper portion 106*b* that are configured to receive tobacco leaves such that the tobacco leaves hang therefrom. The hanging racks 152 may be arranged at least one of serially and in parallel between the lower portion 106*a* and the upper portion 106*b* of the curing chamber 106. In the illustrated embodiment, the flue-curing apparatus 100 includes two upper hanging racks 152*a* and two lower hanging racks 152*b*. FIG. 6 illustrates the flue-curing apparatus 100 when the hanging racks 152 are fully loaded with tobacco leaves 154. However, the flue-curing apparatus 100 may cure lesser quantities of tobacco leaves in other embodiments. For example, only the upper hanging racks 152*a* or the lower hanging racks 152*b* may be employed to cure tobacco leaves.

The access door 110 to the curing chamber 106 may be configured to open and close the curing chamber. The access door 110 to curing chamber 106 and at least one of the hanging racks 152 may be configured to form a seal therebetween when the access door is closed. Thereby, the heated and humidity-controlled air from the air circulation system may be directed through the tobacco leaves hanging from the hanging racks 152.

The flue-curing apparatus 100 may further comprise one or more gasket members 156 operably engaged with at least one of the access door 110 to the curing chamber 106 and at least one of the hanging racks 152 and configured to facilitate the seal therebetween. In particular, the gasket members 156 may be configured to seal a peripheral edge of one or more of the hanging racks 152. For example, as illustrated in FIG. 6, the gasket members 156 may include one or more gasket members 156*a* coupled to the access door 112 to the curing chamber 106 or one or more of the hanging racks 152 proximate the access door to the curing chamber. Accordingly, the gasket members 156*a* may be configured to seal between one of the hanging racks 152 and the access door 112 to the curing chamber 106 such that when the access door to the curing chamber is closed, the gasket members may be compressed between the hanging racks and the access door to the curing chamber.

Figure 7:
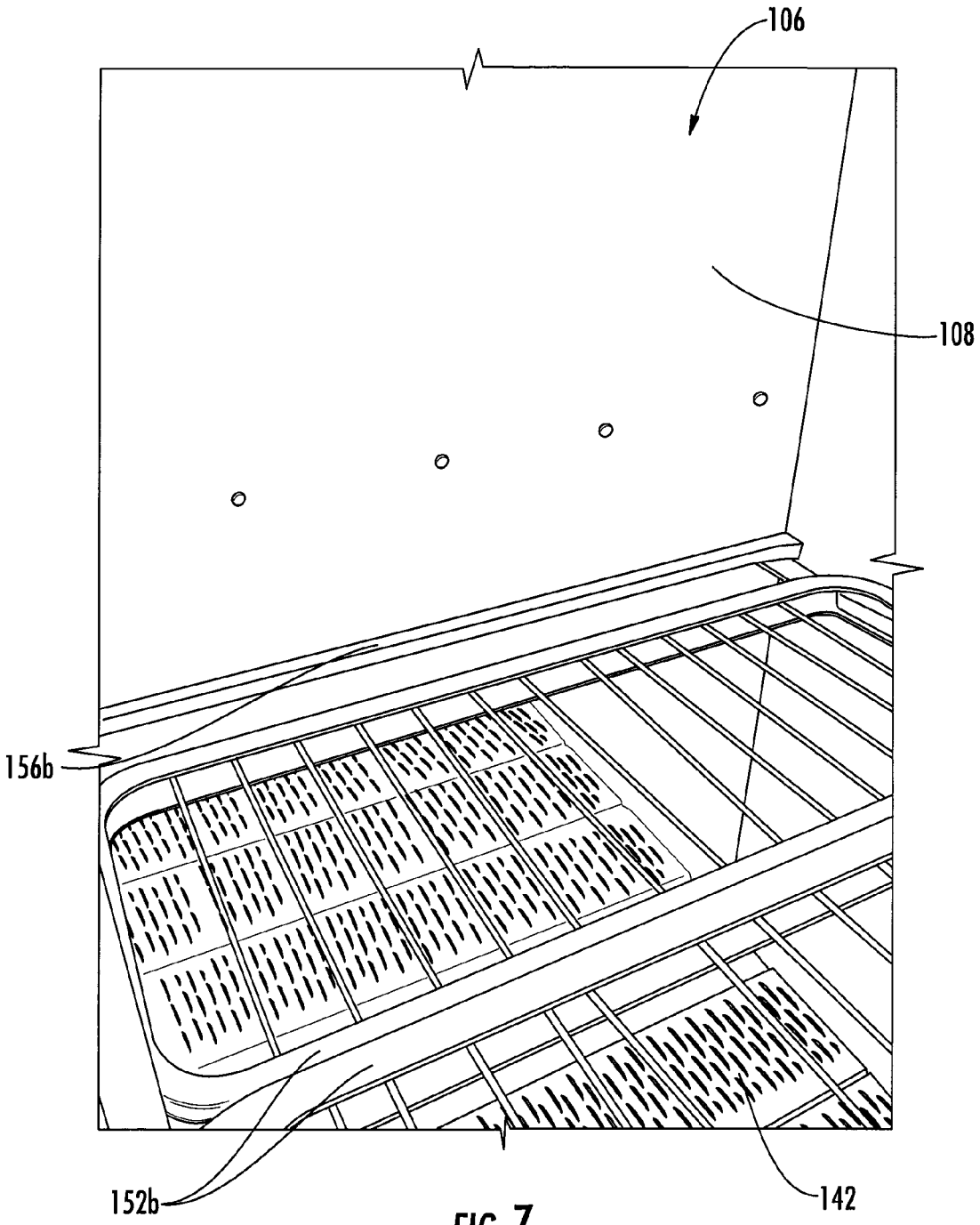
FIG. 7 illustrates an enlarged perspective view of hanging racks in the curing chamber and a seal between one of the hanging racks and a divider wall between the curing and circulation chambers.

Further, as illustrated in FIG. 7, the gasket members 156 may include one or more gasket members 156*b* coupled to the divider wall 108 or one or more of the hanging racks 152 proximate the divider wall. Accordingly, the gasket members 156*a* may be configured to seal between one of the hanging racks 152 and the divider wall 108 such that when the hanging racks are slid fully into the curing chamber 106, the gasket members may be compressed between the hanging racks and the divider wall. Thus, the gasket members 156 may prevent air from traveling around the hanging racks 152, and hence the air may instead travel through the hanging racks. In this regard, the air is directed through any tobacco leaves held by the hanging racks 152 in order to cure the tobacco leaves.

Figure 8:
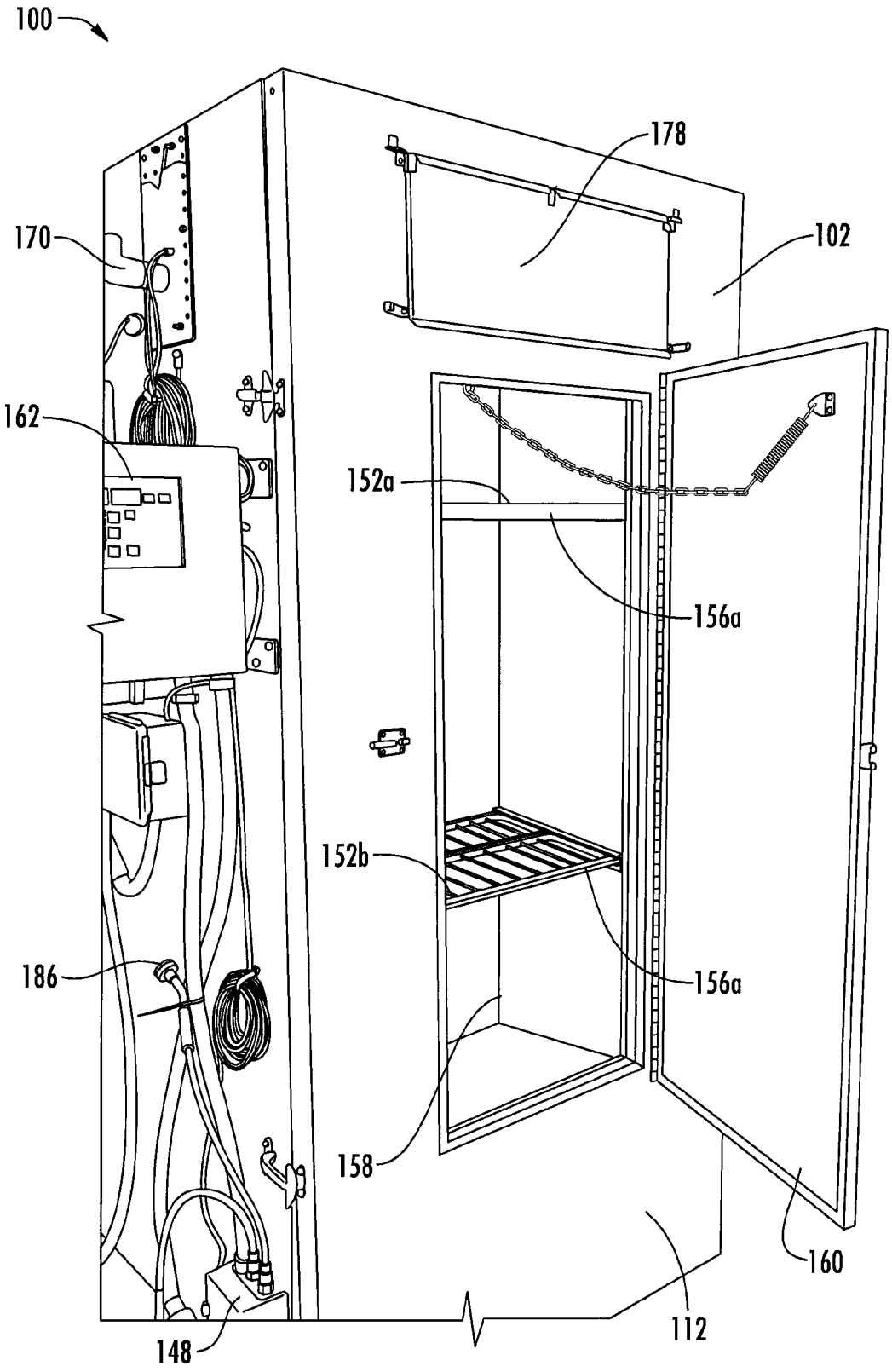
FIG. 8 illustrates a perspective view of the flue-curing apparatus with a door to the curing chamber in a closed configuration.

As illustrated in FIG. 8, in some embodiments the access door 112 to the curing chamber 106 may comprise a transparent viewing window 158 configured to allow visual inspection of the tobacco leaves within the curing chamber. Accordingly, a user may view the tobacco leaves during the curing process to inspect the condition thereof However, in order to provide additional insulation at the transparent viewing window 158, the access door 112 to the curing chamber 106 may further comprise an outer door 160. The outer door 160 may also block light (e.g., sunlight) from entering the curing chamber 106 when the outer door is closed, such that curing conditions are not impacted by light.

Figure 9:
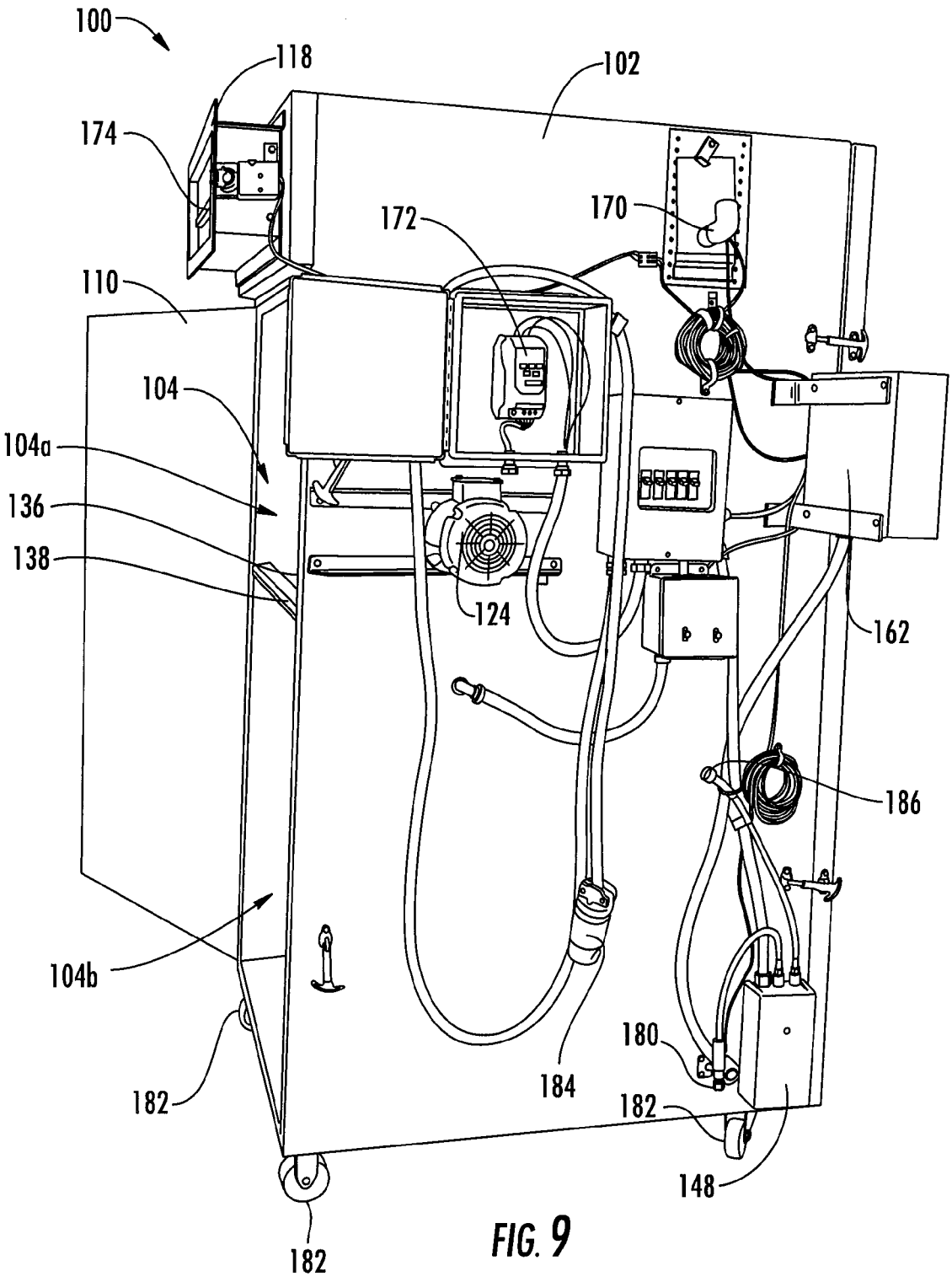
FIG. 9 illustrates a perspective view of a side of the flue-curing apparatus.

Various other components of the flue-curing apparatus 100 are illustrated in FIG. 9. For example, the flue-curing apparatus 100 may additionally comprise a controller 162 configured to control at least one condition of the air at least partially in response to a signal from a sensor in the curing chamber 106. In one example embodiment the controller may comprise a VK-981 controller sold by VenconVersos, of Athens, Greece. Various embodiments of sensors may be provided, and various conditions may be controlled. In the illustrated embodiment, the sensors include a lower dry bulb thermometer 164 (see, e.g., FIG. 5) and an upper dry bulb thermometer 166 (see, e.g., FIG. 6). The controller 162 may employ the lower dry bulb thermometer 164 to determine the temperature of the air initially entering the curing chamber 106, which may be the maximum temperature experienced by the tobacco leaves within the chamber. In this regard, in some embodiments the controller 162 may be configured to control the heater device 130 (e.g., by turning the heating elements 134 on/off and/or controlling the current supplied thereto) based on a signal from the lower dry bulb thermometer 164 to achieve a desired temperature of the air entering the curing chamber 106.

As the air travels through the tobacco leaves, it may cool, or otherwise experience a change in temperature. The upper dry bulb thermometer 166 may produce a signal indicative of the temperature of the air after it travels through the tobacco leaves. Thus, the controller 162 may employ both the lower dry bulb thermometer 164 and the upper dry bulb thermometer 166 to determine a temperature differential of the air upstream and downstream of the tobacco leaves 154. In some embodiments the controller 162 may be configured to prevent the temperature differential from exceeding a maximum temperature differential. In this regard, by establishing a maximum allowable temperature differential, the controller 162 may ensure that each of the tobacco leaves is exposed to substantially the same temperature within the limits set by the maximum temperature differential. Accordingly, relatively even curing of each of the tobacco leaves may be achieved, regardless of the vertical placement of the tobacco leaves in the curing chamber 106. In order to ensure that the maximum temperature differential is not exceeded, the controller 162 may control the heater device 130 (e.g., by turning the heating elements 134 on/off and/or adjusting the current supplied thereto).

The sensors may further comprise a wet bulb thermometer 168 (see, e.g., FIG. 6). In order to provide the wet bulb thermometer 168 with water, the flue-curing apparatus 100 may further comprise a reservoir 170, which may store water therein. Accordingly, the controller 162 may be provided with information from one or more sensors regarding the conditions inside the curing chamber 106 and the controller 162 may operate to adjust the conditions of the air in the curing chamber 106 to achieve a desired curing rate for the tobacco leaves. In this regard, the flue-curing apparatus 100 may include a number of features that allow for adjustment of the rate at which the tobacco leaves are cured. For example, as noted above, controller 162 may turn on/off the heating elements 134 and/or control the current applied thereto to achieve a desired temperature in the curing chamber 106 and maintain the temperature differential between the upper and lower portions 106*b*, 106*a* of the curing chamber below a specified maximum temperature differential. Additionally, the motor 122 that drives the blower 114 may include a speed controller 172 that provides for adjustment of the speed at which the blower operates. Thus, the blower 114 may comprise a variable speed blower.

Further, the flue-curing apparatus 100 may include features configured to control the relative humidity in the curing chamber 106 to more precisely control the curing rate. In this regard, the air circulation system may comprise a fresh air damper 174 at the inlet 118 to the circulation chamber 104. The fresh air damper 174 may be configured to actively control flow of the air through the inlet 118 such that the fresh air damper selectively introduces external air into the air circulated through the curing chamber 106. In this regard, the controller 162 may employ the fresh air damper 174 to control the flow of air that is received through the inlet 118 relative to the proportion of air recirculated from the curing chamber 106 through the upper passage 116. The curing chamber 106 may include an outlet 176 with a passive damper 178 hingedly coupled thereto. The passive damper 178 may open when the fresh air damper 174 opens as a result of the change in the static pressure inside the curing chamber 106. When the passive damper 178 opens, air and moisture may be released from the curing chamber 106 through the outlet 176. Accordingly, the controller 162 may reduce the relative humidity of the air in the curing chamber 106, when the relative humidity is greater than desired, by opening the fresh air damper 174. Conversely, the controller 162 may increase the relative humidity of the air in the curing chamber 106 by employing the humidifier arrangement 144 to release water into the air. In this regard, the humidifier arrangement 144 may further comprise a solenoid valve 180 that controls the flow of heated water to the spray nozzles 146 as directed by the controller 162.

The controller 162 may employ one or more sensors (e.g., one or more of the above-noted sensors) to determine when and/or how to adjust the humidity in the curing chamber 106. For example, the controller 162 may employ the wet bulb thermometer 168 and a nearby dry bulb thermometer (e.g. upper dry bulb thermometer 166) to determine the relative humidity in the curing chamber 106, and in particular the relative humidity in the upper portion 106*b* of the curing chamber in the illustrated embodiment. In this regard, the controller 162 may be configured to determine the relative humidity of the air based at least in part on a temperature differential between the signals provided by the wet bulb thermometer 168 and the upper dry bulb thermometer 166. However, in another embodiment the controller 162 may turn on/off the flow of heated water to the nozzles 146 and/or open/close the fresh air damper 174 based on a signal from the wet bulb thermometer 168, without regard to signals from a dry bulb thermometer.

The apparatus 100 may still include the dry bulb thermometers 164, 166 in embodiments in which the controller 162 does not employ the dry bulb thermometers to control the humidity in the curing chamber 106. For example, the signals from the dry bulb thermometers 164, 166 may be outputted (e.g., by the controller or a separate display). Accordingly, an operator of the apparatus 100 may determine the relative humidity in the curing chamber 106 based on the outputs from the thermometrers 164, 166, 168 by referring to a cyclometric chart, or the controller 162 or other device may calculate and output the relative humidity.

Further, use of separate lower and upper dry bulb thermometers 164, 166 may allow the operator (or the controller 162 or other device) to separately determine the relative humidity in the lower portion 106*a* and the upper portion 106*b* of the curing chamber 106. Thereby, an operator may monitor each relative humidity to ensure that a desired humidity is achieved in both the lower 106*a* and the upper 106*b* portions of the curing chamber 106. This may be useful to ensure that the relative humidity does not drop below a desired relative humidity. For example, during the early stages of curing, it may be desirable to maintain the relative humidity at or about 89% to keep the leaves alive and allow for conversion of starch to sugar.

As illustrated, in some embodiments the flue-curing apparatus 100 may be configured as a mobile unit and include one or more features that facilitate use thereof in a variety of locations. In this regard, the flue-curing apparatus 100 may be mounted to casters 182 (see, e.g., FIG. 5) or other forms of wheels. Thereby the flue-curing apparatus 100 may be relatively easily transported between various locations. Further, power for the flue-curing apparatus 100 may be received through a standard electric cord 184. The electric cord 184 and the various electric components disclosed herein may be configured to receive 220 volts, 110 volts, or any other voltage conveniently available at the location of use in various embodiments. Additionally, the flue-curing apparatus 100 may receive water for the humidifier arrangement 144 through a standard hose connection 186. Accordingly, as a result of the above-noted features, the flue-curing apparatus 100 may be relatively mobile and configured to move between various locations as may be necessary or desirable. Further, as a result of employing the standardized electric cord 184 and hose connection 186, it may be possible to conveniently operate the flue-curing apparatus 100 at a number of differing locations without requiring any specialized equipment or permanent installation.

Figure 10:
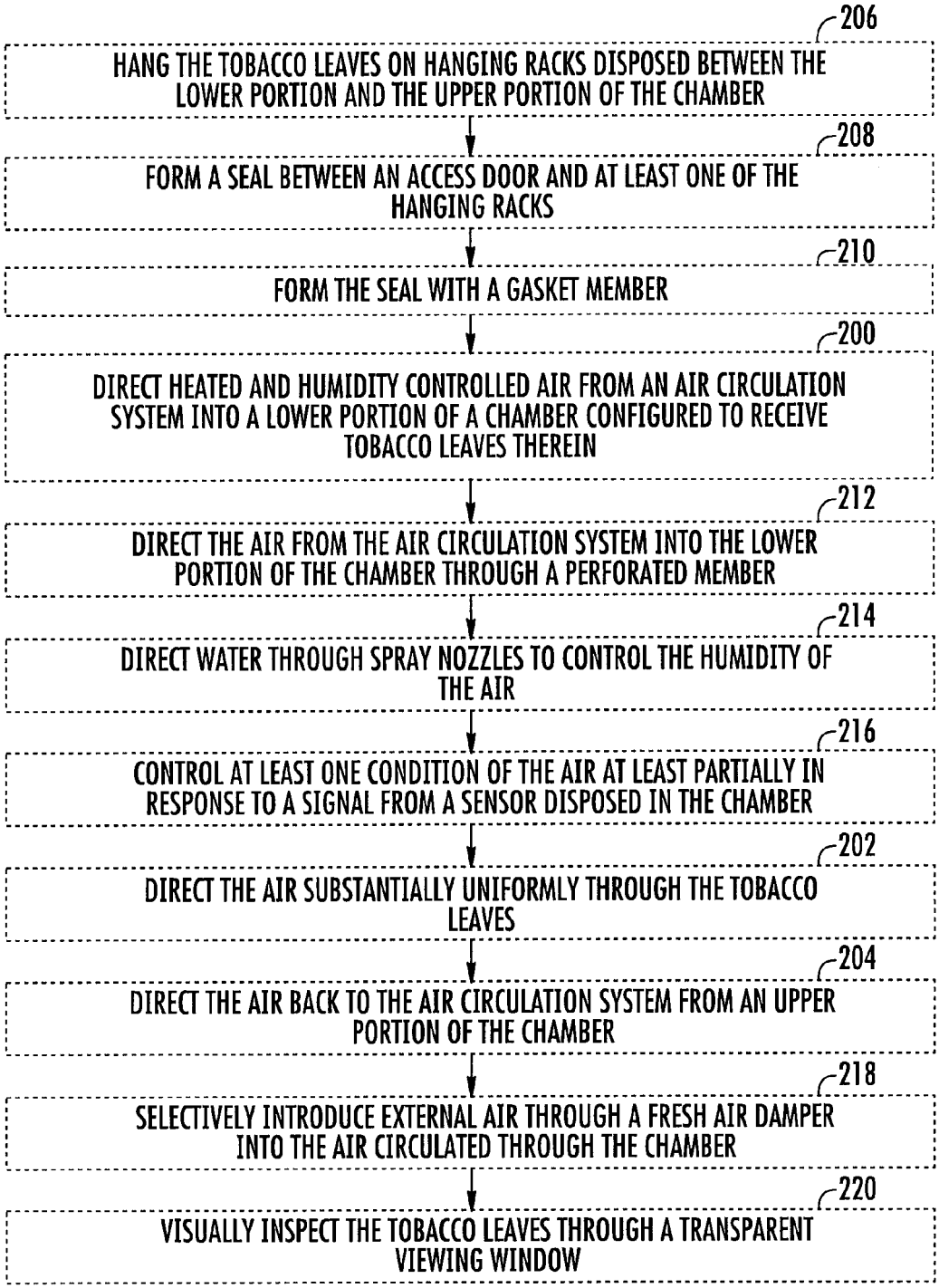
FIG. 10 schematically illustrates a method for curing tobacco according to an example embodiment of the present disclosure.

Embodiments of related methods are also provided. In this regard, FIG. 10 illustrates an example embodiment of a method for flue-curing tobacco. As illustrated, the method may include directing a heated and humidity-controlled air from an air circulation system into a lower portion of a chamber (e.g., the curing chamber 106) configured to receive a plurality of tobacco leaves therein, the chamber being further configured to have a capacity of no more than about twenty five pounds of tobacco leaves at operation 200. Further, the method may include directing the air substantially uniformly through the tobacco leaves, such that the tobacco leaves experience substantially the same heat and humidity associated with the air at operation 202. The method may additionally include directing the air back to the air circulation system from an upper portion of the chamber at operation 204.

In some embodiments the method may additionally include other optional operations, which are indicated by boxes formed with dashed lines. In this regard, the method may further comprise hanging the tobacco leaves on a plurality of hanging racks disposed between the lower portion and the upper portion of the chamber and configured to receive the tobacco leaves at operation 206. Additionally, the method may include forming a seal between an access door, the access door being configured to open and close the chamber, and at least one of the hanging racks, when the access door is closed, such that the heated and humidity-controlled air from the air circulation system is directed through the tobacco leaves hanging from the hanging racks at operation 208. Forming the seal at operation 208 may comprise forming the seal with a gasket member operably engaged with at least one of the access door and the one of the hanging racks and configured to facilitate the seal therebetween at operation 210.

Directing the air from the air circulation system into the lower portion of a chamber at operation 200 may comprise directing the air from the air circulation system into the lower portion of the chamber through a perforated member disposed at the lower portion of the chamber at operation 212. Additionally, the method may include directing water through a plurality of spray nozzles disposed externally to the chamber to control the humidity of the air at operation 214. The method may further comprise controlling at least one condition of the air at least partially in response to a signal from a sensor comprising a wet bulb thermometer disposed in the chamber at operation 216. The method may also include selectively introducing external air through a fresh air damper into the air circulated through the chamber at operation 218. The method may also include visually inspecting the tobacco leaves within the chamber through a transparent viewing window associated with the access door at operation 220.

The apparatuses and methods described herein may allow for curing of relatively small quantities of tobacco leaves. In this regard, the humidity control system may function to maintain sufficient humidity to allow for proper curing of the tobacco leaves. Further, by creating a substantially uniform airflow through the tobacco leaves, each of the tobacco leaves may be dried at a substantially uniform rate. Accordingly, tobacco leaves may be cured in relatively small batches (e.g., up to about 5 pounds, up to about 20 pounds, up to about 25 pounds, or up to about 50 pounds), such that a researcher may be able to cure the tobacco leaves without having to cure the tobacco leaves in a chamber having other tobacco leaves therein.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A flue-curing apparatus for tobacco, comprising:

an air circulation system;

a humidity control system operably engaged with the air circulation system so as to control humidity in air being circulated thereby;

a heater device operably engaged with the air circulation system so as to heat air being circulated thereby;

a chamber operably engaged with the air circulation system and configured to receive a plurality of tobacco leaves therein, the chamber being configured to receive the heated and humidity-controlled air from the air circulation system at a lower portion thereof, the chamber comprising a plurality of hanging racks and an access door, the hanging racks being disposed between the lower portion and an upper portion of the chamber and configured to receive the tobacco leaves such that the tobacco leaves hang therefrom, the access door being configured to open and close the chamber, the access door and at least one of the hanging racks being configured to form a seal therebetween when the access door is closed so as to direct the heated and humidity-controlled air from the air circulation system through the hanging racks, substantially uniformly through the tobacco leaves hanging therefrom such that the tobacco leaves experience substantially the same heat and humidity associated with the air, and back to the air circulation system from the upper portion of the chamber;

a first thermometer configured to produce a first signal corresponding to the temperature of air upstream of the tobacco leaves;

a second thermometer configured to produce a second signal corresponding to the temperature of air downstream of the tobacco leaves; and a controller configured to:

determine a temperature differential between upstream and downstream of the tobacco leaves, and control the heater device at least partially in response to the temperature differential to prevent the temperature at a vertical placement from exceeding a maximum vertical temperature differential within the chamber such that each of the tobacco leaves is exposed to substantially the same temperature regardless of the vertical placement of the tobacco leaves within the chamber.

2. An apparatus according to claim 1, wherein the chamber comprises a perforated member at the lower portion, the chamber being configured to receive the heated and humidity-controlled air from the air circulation system through the perforated member.

3. An apparatus according to Claim 1, wherein the hanging racks are arranged at least one of serially and in parallel between the lower portion and the upper portion of the chamber.

4. An apparatus according to claim 1, further comprising a gasket member operably engaged with at least one of the access door and the one of the hanging racks and configured to facilitate the seal therebetween.

5. An apparatus according to claim 1, wherein the access door of the chamber comprises a transparent viewing window configured to allow visual inspection of the tobacco leaves within the chamber.

6. An apparatus according to claim 1, wherein the humidity control system comprises a plurality of spray nozzles configured to have water directed therethrough.

7. An apparatus according to claim 6, further comprising a drip tray positioned under the spray nozzles so as to collect water dispensed therefrom and not incorporated into the heated and humidity-controlled air.

8. An apparatus according to claim 6, wherein the spray nozzles are configured to receive heated water for direction therethrough.

9. An apparatus according to claim 6, wherein the spray nozzles are disposed externally to the chamber.

10. An apparatus according to claim 6, wherein the humidity control system further comprises a solenoid valve configured to control flow of water to the spray nozzles.

11. An apparatus according to claim 1, wherein the controller is further configured to control at least one condition of air in the chamber at least partially in response to a signal from a wet bulb thermometer.

12. An apparatus according to claim 1, wherein the air circulation system comprises a fresh air damper configured to selectively introduce external air into the air circulated through the chamber.

13. An apparatus according to claim 1, wherein the air circulation system comprises a variable speed blower.

14. An apparatus according to claim 1, wherein the apparatus is configured as a mobile unit.

* * * * *